US009751681B2

(12) United States Patent
Lott et al.

(10) Patent No.: US 9,751,681 B2
(45) Date of Patent: Sep. 5, 2017

(54) NOZZLE FOR A TWO-CHAMBER CONTAINER FOR MIXING TWO COMPONENTS AND APPLYING THE MIXTURE

(71) Applicant: KAO GERMANY GMBH, Darmstadt (DE)

(72) Inventors: Manfred Lott, Darmstadt (DE); Frank Zeiter, Darmstadt (DE)

(73) Assignee: KAO GERMANY GMBH, Darmstadt (DE)

( * ) Notice: Subject to any disclaimer, the term of this patent is extended or adjusted under 35 U.S.C. 154(b) by 35 days.

(21) Appl. No.: 14/441,575

(22) PCT Filed: Dec. 10, 2013

(86) PCT No.: PCT/EP2013/076034
§ 371 (c)(1),
(2) Date: May 8, 2015

(87) PCT Pub. No.: WO2014/090776
PCT Pub. Date: Jun. 19, 2014

(65) Prior Publication Data

US 2015/0291341 A1 Oct. 15, 2015

(30) Foreign Application Priority Data

Dec. 10, 2012 (EP) ..... 12196279

(51) Int. Cl.
*B65D 81/32* (2006.01)
*B65D 47/06* (2006.01)
(Continued)

(52) U.S. Cl.
CPC ..... *B65D 81/3211* (2013.01); *A45D 19/02* (2013.01); *B65D 47/063* (2013.01);
(Continued)

(58) Field of Classification Search
CPC B65D 81/3211; B65D 47/063; B65D 47/065; B65D 47/066; B65D 47/10; B65D 47/20; B65D 51/2871; A45D 19/02
See application file for complete search history.

(56) References Cited

U.S. PATENT DOCUMENTS 1,804,627 A * 5/1931 Lukenbill ..... B65D 47/063 215/271
2,898,018 A * 8/1959 Borah ..... B65D 47/063 222/460

(Continued)

FOREIGN PATENT DOCUMENTS

DE 24 33 319 A1 1/1975
DE 10 2011 000902 B3 12/2011

OTHER PUBLICATIONS

International Search Report dated Mar. 24, 2014, mailed Apr. 1, 2014.

*Primary Examiner* — Anthony Stashick
*Assistant Examiner* — James Way
(74) *Attorney, Agent, or Firm* — Norris McLaughlin & Marcus, P.A.

(57) ABSTRACT

A nozzle for a two-chamber container for mixing two components and applying the mixture, comprises a foldable nozzle body, comprising a mainly ring-shaped connecting part for connecting the nozzle to a container body, wherein the connecting part is arranged at an outer diameter, a tip arranged mainly in the center of the nozzle body, the tip comprises a predetermined breaking line for providing an outlet in broken state, at least one intermediate folding ring connecting the tip with the connecting part so that the tip is movable relative to the connecting part in axial direction between a folded state, where the tip is arranged mainly radially inside the connecting part, and an unfolded state,
(Continued)

Figure 1:
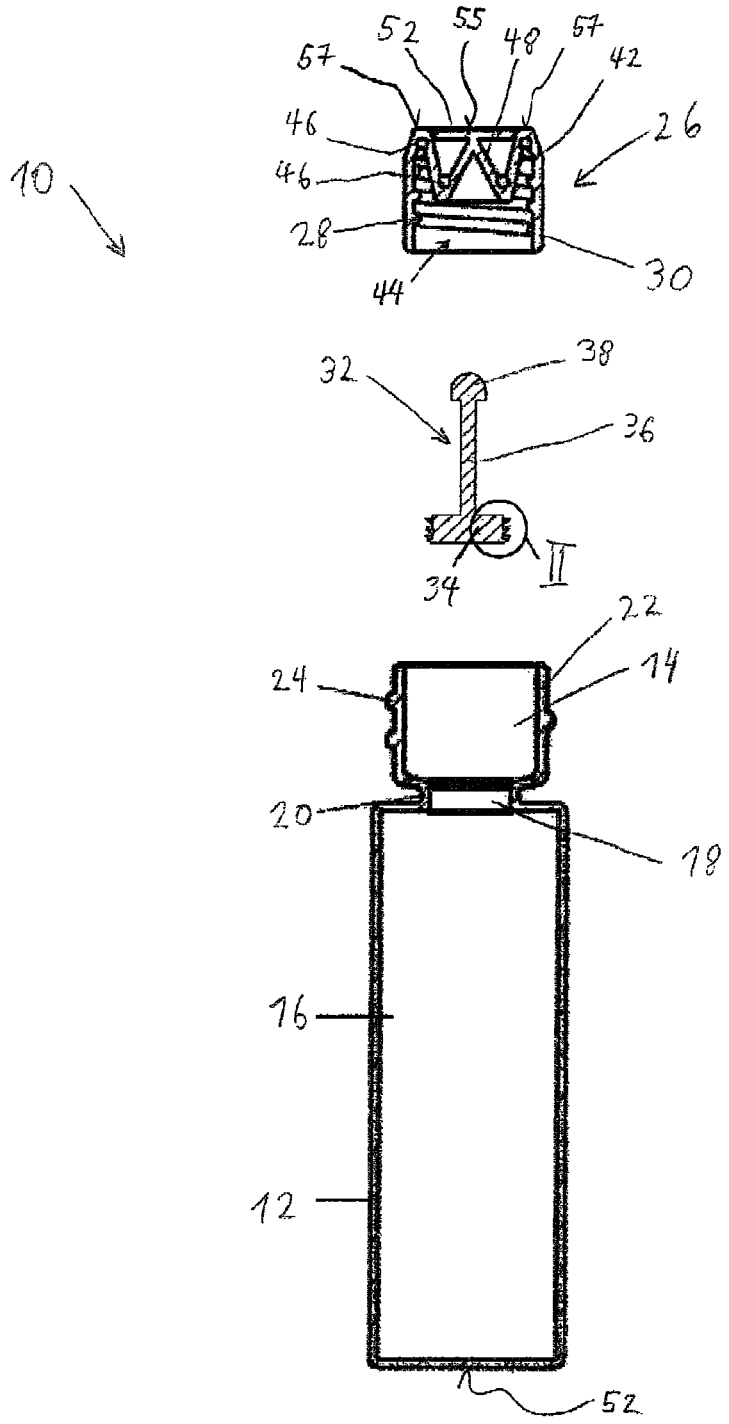

where the tip is arranged mainly outside the connecting part, and a cover plate connected with the tip.

16 Claims, 4 Drawing Sheets

(51) Int. Cl.
*B65D 47/10* (2006.01)
*B65D 51/28* (2006.01)
*A45D 19/02* (2006.01)
*B65D 47/20* (2006.01)

(52) U.S. Cl.
CPC ..... *B65D 47/065* (2013.01); *B65D 47/10* (2013.01); *B65D 47/20* (2013.01); *B65D 51/2871* (2013.01)

(56) References Cited

U.S. PATENT DOCUMENTS 3,220,588 A * 11/1965 Lipari ..... A61J 1/2093 206/222
3,779,413 A * 12/1973 Pickerell ..... A61J 9/008 215/11.1
3,986,646 A 10/1976 Strub
4,073,413 A * 2/1978 Tabler ..... B65D 47/063 222/529
5,531,363 A * 7/1996 Gross ..... B65D 47/2031 222/494
5,593,028 A * 1/1997 Haber ..... A61J 1/2093 206/219
5,875,888 A * 3/1999 Albisetti ..... B65D 25/087 206/221
6,003,728 A 12/1999 Elliott
8,613,372 B2 * 12/2013 Porter ..... B65D 41/3428 206/219
8,701,906 B1 * 4/2014 Anderson ..... B65D 41/20 206/220
9,132,950 B1 * 9/2015 Anderson ..... B65D 81/32
2007/0005027 A1 * 1/2007 Talamonti ..... A01N 25/34 604/290
2011/0114679 A1 * 5/2011 Park ..... B65D 47/063 222/529
2012/0085794 A1 4/2012 Selina et al.
2015/0090617 A1 * 4/2015 Reza ..... B65D 25/085 206/221

* cited by examiner

NOZZLE FOR A TWO-CHAMBER CONTAINER FOR MIXING TWO COMPONENTS AND APPLYING THE MIXTURE

This application is a 371 application of PCT/EP2013/076034 filed Dec. 10, 2013, which claims foreign priority benefit under 35 U.S.C. §119 of European Application No. 12196279.9 filed Dec. 10, 2012, the disclosures of which are incorporated herein by reference.

The invention relates to a nozzle for a two-chamber container for mixing two components and applying the mixture, by means of which the chambers of the container can be connected with each other for mixing the content of the chambers as well as for applying the mixture, particularly for applying a mixed hair tinting means to human hair.

From US 2012/0085794 a nozzle for a one-chamber container is known, which comprises a foldable nozzle body. The nozzle body comprises a ring shaped connecting part connected to a deck of the container at the outer diameter of the nozzle body. The nozzle body further comprises several intermediate rings arranged subsequent at lower diameters so that in folded state the nozzle body is flat and the intermediate rings as well as the connecting part are arranged in radial direction in series. In unfolded state the intermediate rings as well as the connecting part are arranged mainly in axial direction in series providing a spout. The intermediate ring with the smallest diameter comprises an outer thread to which a cap is screwed. The cap comprises a pull-ring which protrudes from the nozzle body in radial direction. The pull-ring is easily accessible from outside so that a person may pull the pull-ring with a finger for pulling the nozzle body from the folded state into the unfolded state. In the unfolded state the cap can be unscrewed from the nozzle body for pouring out the content of the container.

It is possible that a hair tinting means is a mixture of reactive components which have to be applied immediately as long as the components are still reactive. For that reason it is possible storing two different components in two different chambers of a two-chamber container. As long as both components are separated mainly no reaction takes place. When the hair tinting means should be applied both chamber have to be connected with each others first for mixing the components. After the components are mixed the hair tinting means can be applied to human hair via a nozzle connected to the two-chamber container. The handling with a two-chamber usually includes two different tasks, namely mixing the components stored in two different chambers and pouring out the mixture, wherein both tasks have to be performed in the right order. There is a permanent need facilitating the handling with a two-chamber container.

It is an object of the invention providing measures enabling a facilitated handling with a two-chamber container.

The solution of this object is provided according to the invention by a nozzle for a two-chamber container according to the features of claim 1. Preferred embodiments of the invention are given by the dependent claims, which can constitute each solely or in combination an aspect of the invention.

An aspect of the invention is directed to a nozzle for a two-chamber container for mixing two components and applying the mixture, comprising a foldable nozzle body, particularly made from a flexible material, the nozzle body comprising a mainly ring-shaped connecting part for connecting the nozzle to a container body, wherein the connecting part is arranged at an outer diameter, a tip arranged mainly in the centre of the nozzle body, wherein the tip comprises a predetermined breaking line for providing an outlet in broken state, at least one intermediate folding ring connecting the tip with the connecting part so that the tip is movable relative to the connecting part in axial direction between a folded state, where the tip is arranged mainly radially inside the connecting part, and an unfolded state, where the tip is arranged mainly outside the connecting part, and a cover plate connected with the tip for covering the tip inside a volume bordered by the folding ring directly connected to the connecting part in folded state.

Due to the cover plate the tip of the nozzle body is not easily accessible for a person so that the tip of the nozzle can not pulled out for unfolding the nozzle body. Particularly the cover plate may comprise the appearance like a push button. Preferably the cover plate may comprises a corresponding marking or writing on an outside surface pointing away from the tip that would lead a person not to pull but to push the nozzle body via the cover plate. Hence the natural behavior of person using a two-chamber container provided with such kind of nozzle, particularly for applying a hair tinting means, would not be pulling the nozzle but pushing the nozzle. Due to the foldability and/or flexibility of the nozzle body the tip can be pushed downwards against an opening direction from the folded state to the unfolded state.

By pushing down the tip of the nozzle body a plug plugging a connection channel connecting two different chambers of the two-chamber container can be pushed away so that the components of both chambers can be mixed. For unfolding the nozzle body a pressure may be applied to the nozzle body from inside the nozzle, for example by means of a sufficiently increasing inside gas pressure inside the container due to generated gaseous components when the content of the both chambers are mixed. In addition or in the alternate the pressure applied to the inside of the nozzle for unfolding the nozzle body may be provided by mechanical means. In the unfolded state the tip is accessible and can be broken along the breaking line by a person for opening an outlet. The mixture of the two-chamber container may be poured out via the outlet which usually can be only provided in the unfolded state of the nozzle body. The risk that the nozzle is opened for pouring out the content of a two-chamber container without mixing the components of both chambers before is at least significantly reduced so that a facilitated handling with the two-chamber container is enabled.

Preferably, the parts of the nozzle body may be arranged in radial direction mainly in series in the folded state. Particularly the connecting part covers 98%-100% of the axial extension of the intermediate folding ring(s) and/or the tip in side view in folded state of the nozzle body. Particularly preferred the connecting part may cover also the cover plate in side view in folded state of the nozzle body. The cover plate may comprise an outside surface pointing away from the tip, wherein the outside surface is flush with an upper rim of the folding ring(s) in the folded state or the outside surface is arranged on a level below the upper rim of the folding ring(s) in the folded state, when the nozzle is placed upright in an alignment like being connected to an upper outlet connection of an container placed upright onto a horizontal ground. The cover plate may be placed sunk into a volume radially bordered by the folding ring(s). Particularly the whole outside surface is positioned on or below the level of the upper rim of the folding ring(s) so that no latch or other part protrudes from the level of the outside surface above the level of the upper rim of the folding ring(s).

Particularly the whole outside surface of the cover plate is an even plain so that protruding parts which could be grabbed for pulling the cover plate and the tip outwards are omitted. Preferably, no part protrudes from the outside surface of the cover plate upwards and even more no part of the cover plate or part directly connected to the cover plate protrudes above the level of the upper rim of the folding ring in the folded state. However it is possible in the alternate that the cover plate protrudes in axial direction, particularly for axially abutting the connecting part in folded state of the nozzle body.

Particularly, the connecting part, the intermediate part(s) and the tip may have a zigzag course like an accordion in the folded state in sectional side view. The nozzle body may be designed like a funnel in the unfolded state, wherein preferably the tip of the funnel ends in the designated outlet closed by the cover plate. Particularly the breaking line may be provided in the transition between the tip and the cover plate. The breaking line may be an intended weakness in the material of the nozzle body, for instance a smaller wall thickness. In the unfolded state the tip particularly may be moved along an opening direction until the tip is spaced to the connection part via the at least one intermediate folding ring in axial direction so that the tip may be arranged completely outside the volume bordered by the connecting part.

The connecting part of the nozzle body may be adapted to be releasably or unreleasably connected to a container. The length of the connecting part in axial direction may be significantly longer than the length of the intermediate folding ring or the tip for providing a sufficient connection with the container. Particularly the intermediate folding ring(s) may comprise a constant axial length along circumferential direction. However it is possible that the length differs for providing a curved course of the nozzle in unfolded state. The intermediate folding ring(s) may be flexible connected like a hinge to the connecting part and/or the tip so that the nozzle body is foldable at the transition area between the intermediate folding ring(s) with the connecting part and/or the tip and/or, if so, with each others. Particularly a film hinge or the like may be provided.

In the folded state an outer surface of the intermediate folding ring, which is directly connected to the connecting part, pointing outwards in the unfolded state may point mainly radially inwards in the folded state bordering the volume where the tip is located in folded state. Due to the cover plate the tip may be mainly inaccessible for a person. Particularly the cover plate may be arranged mainly inside the volume bordered by the outer surface of the intermediate folding ring, which is directly connected to the connecting part. If a person tries to reach the tip his fingers would meet the outside surface of the cover plate or the outer surface of the intermediate folding ring. When the person tries to reach the rim of the cover plate it could be more likely that the cover plate is pushed downwards together with the tip for connecting the chambers of the two-chamber container than gripping the cover plate for pulling the tip out in the unfolded state.

Particularly the folding ring directly connected to the connecting part in folded state borders a maximum area $A_{fr}$ in folded state and the cover plate comprises an area $A_{cp}$, wherein the ratio $A_{cp}/A_{fr}$ is $0.75 \leq A_{cp}/A_{fr} \leq 1.20$, particularly $0.80 \leq A_{cp}/A_{fr} \leq 1.10$, preferably $0.850 \leq A_{cp}/A_{fr} \leq 1.00$ more preferred $0.90 \leq A_{cp}/A_{fr} \leq 0.99$ and most preferred $0.95 \leq A_{cp}/A_{fr} < 0.98$. Since at least a mayor part of area $A_{fr}$ of the volume bordered by the intermediate folding ring is covered by the cover plate, a finder of a person may not reach between the folding ring an the cover plate for gripping the cover plate. Particularly a minimum distance d between the cover plate and the folding ring is $0.0\ mm \leq d \leq 5.0\ mm$, preferably $0.5\ mm \leq d \leq 4.0\ mm$, more preferred $1.0\ mm \leq d \leq 3.0\ mm$ and most preferred $d = 2.0\ mm \pm 0.5\ mm$.

Preferably the predetermined breaking line is breakable by turning and/or pulling the cover plate. In the unfolded state the cover plate is easily accessible by a person for being turned and/or pulled so that an outlet can be provided by breaking the breaking line. Particularly the breaking line is provided at a transition area between the tip and the cover plate.

Particularly preferred the tip is movable from the folded state to the unfolded state along an opening direction and also movable in the folded state against the opening direction along a pushing direction, particularly for pushing a plug arranged inside a connection channel between two chambers of a two-chamber container. Due to the foldability and/or flexibility of the nozzle body a movement along the pushing direction against the opening direction is possible. The design and the flexibility of the nozzle body are chosen such that a significant distance along the pushing direction for pushing a plug away is possible. Preferably the tip is at least movable in pushing direction along a distance s of $0.2\ cm \leq s \leq 5.0\ cm$, particularly $0.5\ cm \leq s \leq 4.0\ cm$, preferably $1.0\ cm \leq s \leq 3.0\ cm$ and most preferred $s = 2.0\ cm \pm 0.5\ cm$.

Particularly the tip is movable from the folded state to the unfolded state due to a minimum pressure p applied to the at least one intermediate folding ring and/or the tip, wherein particularly the minimum pressure p is only applicable to a part of the intermediate folding ring directly connected with the connecting part preferably by means of an outlet connection of a container, wherein particularly $0.40\ bar \leq p \leq 3.00\ bar$, preferably $0.50\ bar \leq p \leq 2.00\ bar$, more preferred $0.75\ bar \leq p \leq 1.50\ bar$ and most preferred $1.00\ bar \leq p \leq 1.25\ bar$ applies. The pressure p may be applied to a mayor part of the nozzle body particularly by means of a gas inside the container comprising a corresponding inside gas pressure and/or by means of a mechanical means particularly to a lesser part of the nozzle body. The pressure particularly applies at the intermediate folding ring so that the tip of the nozzle may suddenly pop out at a sufficient pressure in the unfolded state.

Preferably the connecting part comprises a thread for being thread onto an outlet connection of a container. Due to the thread the nozzle may be screwed further to the outlet connection of the container so that the upper rim of the outlet connection may meet the intermediate folding ring. When the nozzle is screwed further at this point the rim of the outlet connection applies an increasing pressure to the folding ring pushing the folding ring in opening direction. When the applied pressure is high enough the nozzle body may pop out into the unfolded state. It is not necessary to grip one part of the nozzle body for pulling the nozzle body in the unfolded state. Turning the nozzle body is sufficient so that the handling is facilitated. Particularly preferred a stop is provided for stopping an unscrewing of the nozzle from the outlet connection. Particularly the thread may at least partially designed like a ratchet brace so that it may be ensured that the nozzle can be screwed onto the outlet connection but not unscrewed from the outlet connection.

Particularly preferred the nozzle body is one-piece and particularly made from a thermoplastic elastomer. Due to the elastomeric material the tip of the nozzle body can be pushed along a sufficient length when the nozzle body is in the folded state. The connection part, the intermediate folding ring(s), the tip and the cover plate may be manufactured by injection molding for instance with a two-half mold and one core inset. A film hinge between subsequent parts and/or the breaking line provided by means of a smaller thickness may be provided by an appropriate design of the mold. Further a thread of the connecting part may be provided by means of the mold design. The manufacture of the nozzle may be facilitated.

Particularly the thickness of the nozzle body is thinner at a transition between the connecting part and the intermediate folding ring and/or between the intermediate folding ring and a further intermediate folding ring and/or between the intermediate folding ring and the tip for providing a designated folding line. The designated folding line may be designed like a film hinge. Due to the thinner parts of the nozzle body a predictable arrangement in folded state may be provided.

The invention is further directed to a use of a nozzle as previously described for closing a two-chamber container. Particularly the nozzle is used for pushing a plug out of a connection channel between two chambers by pushing the cover plate in a pushing direction. Preferably the nozzle is unfolded in an opening direction by applying a pressure at the inside of the nozzle body pointing towards the content of the two-chamber container. Particularly preferred the nozzle is used for pouring out the content of the two-chamber container via the tip after breaking the breaking line. The risk that the nozzle is opened for pouring out the content of a two-chamber container without mixing the components of both chambers before is at least significantly reduced so that a facilitated handling with the two-chamber container is enabled.

The invention is further directed to a container for storing and mixing two components, comprising an upper chamber for storing a first component, a lower chamber for storing a mainly liquid second component and mixing the first component with the second component, a connection channel connecting the upper chamber with the lower chamber, a plug for sealing the connection channel, wherein the plug is movably receivable by the connection channel, and a nozzle, which may be designed as previously described, connected to an outlet connection provided by the upper chamber. Particularly the container may be further designed as previously described. The risk that the nozzle is opened for pouring out the content of a two-chamber container without mixing the components of both chambers before is at least significantly reduced so that a facilitated handling with the two-chamber container is enabled.

When the container is placed in upright position onto a ground the upper chamber may be positioned above the lower chamber in direction of gravity. The lower chamber may comprise a standing surface to be placed onto the ground. The nozzle may be located at the highest point of the container connected to the outlet connector. The plug may be frictionally engaged inside the connection channel sealing the connection channel such that the second component of the lower chamber is separated from the first component of the upper chamber. Particularly the nozzle may meet the plug when pushed for pressing the plug through the connection channel into the lower chamber. In this situation the first component of the upper chamber may flow into the lower chamber so that both components may be mixed. The lower chamber comprises a volume which is large enough receiving not only the second component but also the first component and the plug. If so, the volume of the lower chamber is large enough for providing an additional volume for facilitating a mixing of the components by shaking the container by hand. Particularly the connecting channel is designed like a narrow neck between the upper chamber and the lower chamber, wherein preferably the length of the connection channel in axial direction is much lower than the axial length of the upper chamber or the lower chamber. Preferably the axial length z of the connection channel is 0.2 cm≤z≤5.0 cm, particularly 0.5 cm≤z≤4.0 cm, preferably 1.0 cm≤z≤3.0 cm and most preferred z=2.0 cm±0.5 cm.

Particularly the tip of the nozzle is moveable relative to the connecting part towards the lower chamber such that the tip is able pushing the plug through the connection channel inside the lower chamber. Due to the flexibility of the nozzle body a movement along the pushing direction against the opening direction is possible. The design and the flexibility of the nozzle body are chosen such that a significant distance along the pushing direction for pushing the plug away is possible. Preferably the tip is at least movable in pushing direction along a distance s of 0.2 cm≤s≤5.0 cm, particularly 0.5 cm≤s≤4.0 cm, preferably 1.0 cm≤s≤3.0 cm and most preferred s=2.0 cm±0.5 cm.

Preferably the plug comprises a stem protruding at least partially through the upper chamber towards the tip of the nozzle. The nozzle does not have to be pushed through the whole axial length of the upper chamber. Due to the stem the plug may reach until close to the nozzle body. Particularly the stem terminates into a particularly rounded head so that tolerances regarding the axial position of the plug and/or the alignment of the plug relative to the connecting channel may be at least partially compensated.

Particularly preferred the upper chamber, particularly the outlet connection, comprises an outer thread for screwing the nozzle with the upper chamber. Due to the thread the nozzle may be screwed further to the outlet connection of the container so that the upper rim of the outlet connection may meet the intermediate folding ring so that the nozzle body may pop out into the unfolded state. It is not necessary to grip one part of the nozzle body for pulling the nozzle body in the unfolded state. Turning the nozzle body is sufficient so that the handling is facilitated. Particularly preferred a stop is provided for stopping an unscrewing of the nozzle from the outlet connection. Particularly the thread may at least partially designed like a ratchet brace so that it may be ensured that the nozzle can be screwed onto the outlet connection but not unscrewed from the outlet connection.

Particularly the upper chamber, particularly the outlet connection, abuts the intermediate folding ring for pushing the tip from the folded state into the unfolded state, when the nozzle is screwed onto the upper chamber. When the nozzle abuts the outlet connection an increasing pressure to the folding ring pushing the folding ring in opening direction is provided by the outlet connection. When the applied pressure is high enough the nozzle body may pop out into the unfolded state. It is not necessary unfolding the nozzle body by means of an increasing inside gas pressure inside the container.

Preferably the first component and the second component are provided, wherein the mixture of the first component and the second component produces a gaseous component for increasing the inside gas pressure inside the container. Particularly preferred an effervescent powder is part of the mixture for providing an increased inside gas pressure inside the container. Preferably the second component of the lower chamber is a liquid and the first component of the upper chamber comprises solid parts, particularly the effervescent powder which can be dissolved in the liquid of the second component.

Particularly preferred at least the lower chamber is made from a flexible material for squeezing the container. By squeezing the container the volume provided by the container may be reduced so that in turn the inside gas pressure of the container may be increased. If so, a spring may be actuated by squeezing the container, wherein the spring may press the plug upwards into the upper chamber and pushing the tip of nozzle in opening direction by means of the plug at the same time.

Figure 2:
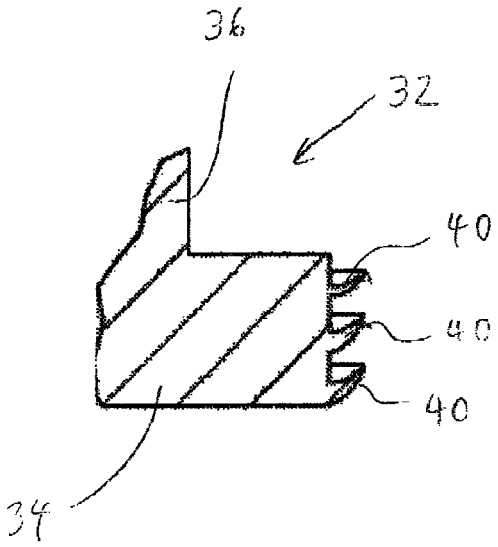
Figure 3:
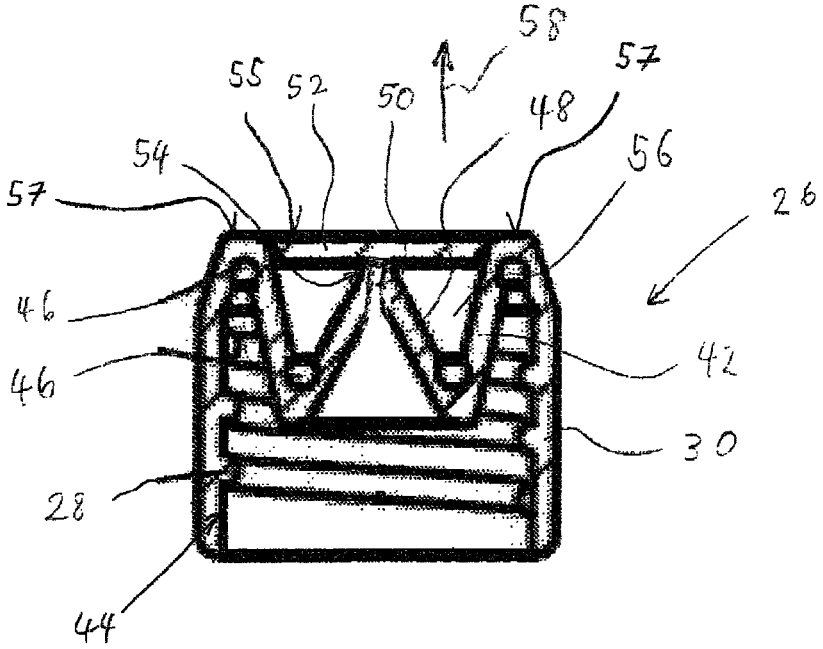
Figure 4:
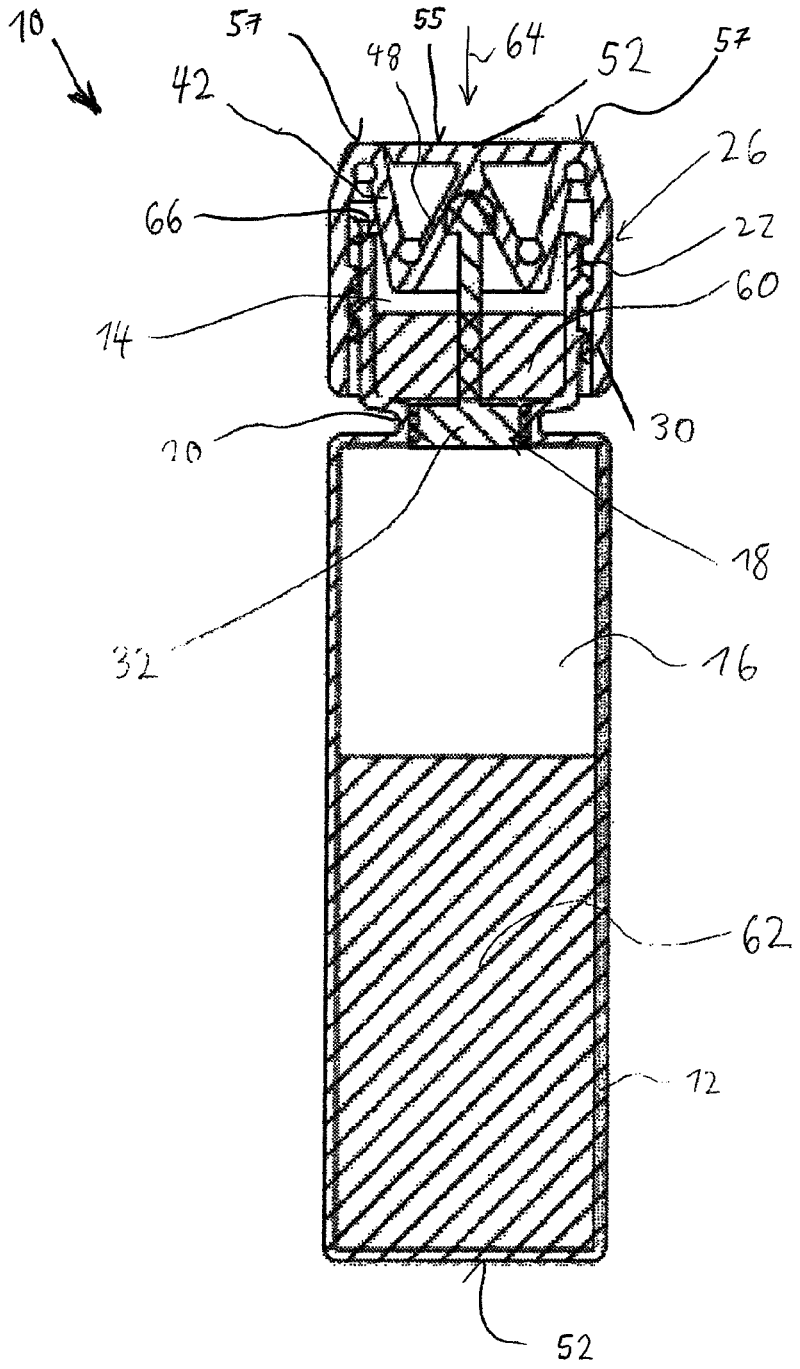
Figure 5:
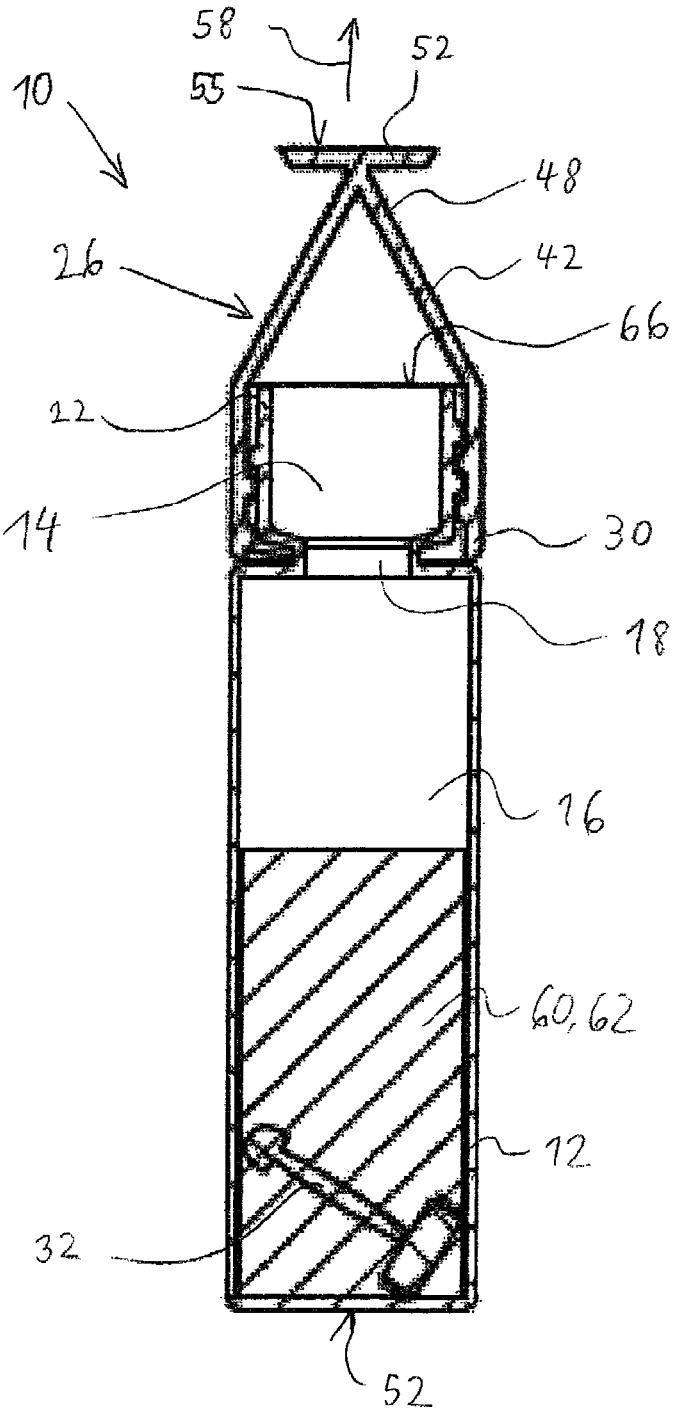

These and other aspects of the invention will be apparent from and elucidated with reference to the embodiments described hereinafter, wherein the described features can constitute each solely or in combination an independent aspect of the invention. In the drawings:

FIG. 1: shows a schematic sectional side view of a two-chamber container in exploded view, FIG. 2: shows a schematic sectional side view of a detail of a plug of the container of FIG. 1, FIG. 3: shows a schematic sectional side view of a nozzle of the container of FIG. 1 in folded state, FIG. 4: shows a schematic sectional side view of the two-chamber container of FIG. 1 in assembled state and FIG. 5: shows a schematic sectional side view of the two-chamber container of FIG. 3 in unfolded state.

The two-chamber container 10 as illustrated in FIG. 1 comprises a bottle body 12 by which an upper chamber 14 and a lower chamber 16 connected via a connecting channel 18 is provided one-piece. The connecting channel 18 is formed by a narrow neck 20 between the upper chamber 14 and the lower chamber 16. In the illustrated embodiment the bottle body 12 of the upper chamber 16 forms an outlet connection 22 which is provided with an outer thread 24. A nozzle 26 can be screwed with the outlet connector 22 of the upper chamber 14 via an inner thread 28 provided by a circular ring-shaped connecting part 30.

A plug 32 is provided comprising a plug part 34 for plugging the connection channel 18. The plug 32 comprises a stem 36 connected with the plug part 34 and terminating in a rounded head 38. As illustrated in FIG. 2 showing detail II of FIG. 1 the plug part 34 may comprise at least one, particularly several, like three, circumferential lamellae 40 protruding in radial direction from the plug part 34. The free ends of the lamellae 40 are slightly bended upwards facilitating inserting the plug 32 into the connecting channel 18.

The nozzle 26 as illustrated in FIG. 3 comprises at least one intermediate folding ring 42, wherein in the illustrated embodiment exactly one folding ring 42 is provided. The folding ring 42 is connected with the connecting part via a reduced thickness of the material of a nozzle body 44 so that a film hinge 46 is provided. A funnel-like tip 48 is provided in the centre of the nozzle body 44 also connected via a reduced thickness of the material of a nozzle body 44 so that another film hinge 46 is provided. Due to the flexible material of the nozzle body 44 and/or the provided film hinges 46 the nozzle 26 is foldable into the folded state as illustrated in FIG. 3 and can be unfolded into an unfolded state by moving the tip 48 relative to the connecting part 30 along an opening direction 58.

The tip 48 comprises an outlet 50 pointing mainly upwards when the container 10 is placed onto a ground via a standing surface 52 of the lower chamber 16 in upright position of the container 10. The outlet 50 is closed with a cover plate 52 extending in mainly radial direction. The thickness of the material of the nozzle body 44 between the cover plate 52 and the tip 48 is such small that a circumferential breaking line 54 is provided. When the cover plate 52 is turned or pulled the cover plate 52 can be sheared off the tip 48 opening the outlet 50. In the illustrated embodiment the cover plate 52 is mainly complete arranged inside a volume 56 radially bordered by the folding ring 42. Further the cover plate 52 is mainly flush with the transition area between the connecting part 30 and the folding ring 42 so that the tip 48 is mainly not accessible from outside the volume 56. The transition area between the connecting part 30 and the folding ring 42 defines an upper rim 57 of the folding ring 42 in the folded state. The cover plate 52 may comprise an outside surface 55 pointing away from the tip 48, wherein the whole, particularly even, outside surface 55 is flush with the upper rim 57 of the folding ring 42 in the illustrated folded state. Further it is possible that the whole outside surface 55 of the cover plate 52 is arranged below the level of the upper rim 57. No part protrudes from the outside surface 55 of the cover plate 52 upwards and even more no part of the cover plate 52 or part directly connected to the cover plate 52 protrudes above the level of the upper rim 57 of the folding ring 42 in the folded state.

In assembled state of the two-chamber container 10 as illustrated in FIG. 4 the upper chamber 14 comprises a first component 60 and the lower chamber 16 comprises a second component 62, wherein the first component 60 and the second component 62 are separated from each other by the plug 32 inserted into the connecting channel 18 so that the connecting channel 18 is sealed by the plug 32. The plug 32 may reach close to the tip 48 or abutting the tip 48.

When a person presses the cover plate 52 against the opening direction 58 along a pushing direction 64, the tip 48 is pressed downwards so that in turn the plug 32 is also pressed downwards out of the connecting channel 18 falling into the lower chamber 16. After this the connecting channel 18 is open and the first component 60 flows through the connecting channel 18 into the lower chamber 16 for being mixed with the second component 62. Due to the flexibility of the nozzle body 44 the tip 48 moves back in the folded state when no pressure applies anymore in pushing direction 64. In this situation an upper rim 66 of the outlet connector 22 may be spaced to the folding ring 42.

For unfolding the nozzle 26 the nozzle body 44 may be screwed further onto the outlet connector 22 until the upper rim 66 of the outlet connector 22 meets the folding ring 22. When the nozzle 26 is screwed further the pressure applied from the upper rim 66 to the folding ring 22 in opening direction 58 increases until the folding ring 22 together with the tip 48 pops out in the unfolded state as illustrated in FIG. 5. In the unfolded state of the nozzle 26 of the tip 48 becomes accessible so that the cover plate 52 can be sheared off easily for opening the outlet 50 of the tip 48.

The invention claimed is:

1. A nozzle for a two-chamber container for mixing two components and applying the mixture, the nozzle comprising a foldable nozzle body made from a flexible material, the nozzle body comprising a mainly ring-shaped connecting part for connecting the nozzle body to a container body, wherein the connecting part is arranged at an outermost diameter of the nozzle body, a tip arranged mainly in the center of the nozzle body, wherein the tip comprises a predetermined breaking line for opening an outlet of the tip, if the predetermined breaking line is in a broken state, at least one intermediate folding ring connecting the tip with the connecting part such that the tip is movable relative to the connecting part in axial direction between a folded state and an unfolded state, wherein, if the tip is in the folded state, the tip is arranged mainly radially inside the connecting part, and wherein, if the tip is in the unfolded state, the tip is arranged mainly outside the connecting part, and a cover plate connected with the tip at the predetermined breaking line of the tip and directly covering the outlet of the tip, if the tip is in the folded state and positioned inside a volume bordered by the intermediate folding ring directly connected to the connecting part, wherein, if the tip is in the unfolded state and the nozzle body is located in an upright position, a total length of the tip is defined between a bottommost end of the tip adjacent to the intermediate folding ring and an uppermost end of the tip located opposite with respect to the bottommost end of the tip and adjacent to the outlet of the tip, and wherein, if the tip is in the unfolded state and the nozzle body is located in the upright position, the cover plate, the predetermined breaking line of the tip and the outlet of the tip are provided at the uppermost end of the tip, and further wherein, if the nozzle body is located in the upright position, the predetermined breaking line is provided at a transition area between the tip and the cover plate at the uppermost end of the tip.

2. The nozzle according to claim 1, wherein, if the tip is in the folded state, the intermediate folding ring directly borders a maximum area $A_{fr}$ in folded state and the cover plate comprises an area $A_{cp}$, wherein the ratio $A_{cp}/A_{fr}$ is $0.75 \leq A_{cp}/A_{fr} \leq 1.20$.

3. The nozzle according to claim 1, wherein the predetermined breaking line is breakable by at least one selected from turning the cover plate and pulling the cover plate.

4. The nozzle according to claim 1, wherein the tip is movable from the folded state to the unfolded state along an opening direction and is movable in the folded state against the opening direction along an opposite pushing direction.

5. The nozzle according to claim 1, wherein the tip is movable from the folded state to the unfolded state due to a minimum pressure p applied to the at least one selected from the intermediate folding ring and the tip, wherein the minimum pressure p is applicable to a part of the intermediate folding ring directly connected with the connecting part by means of an outlet connection of a container, wherein 0.40 bar $\leq p \leq 3.00$ bar applies.

6. The nozzle according to claim 1, wherein the connecting part comprises a thread for being thread onto an outlet connection of the container.

7. The nozzle according to claim 1, wherein the nozzle body is one-piece made from a thermoplastic elastomer.

8. The nozzle according to claim 1, wherein the thickness of the nozzle body is thinner at a transition between at least one selected from (i) the connecting part and the intermediate folding ring, (ii) the intermediate folding ring and a further intermediate folding ring, and (iii) the intermediate folding ring and the tip.

9. A container for storing and mixing two components, the container comprising an upper chamber for storing a first component, a lower chamber for storing a second component and mixing the first component with the second component, a connection channel connecting the upper chamber with the lower chamber, a plug for sealing the connection channel, wherein the plug is movably receivable by the connection channel, and the nozzle according to claim 1 connected to an outlet connection provided by the upper chamber.

10. The container according to claim 9, wherein the tip of the nozzle is moveable relative to the connecting part of the nozzle body towards the lower chamber of the container such that the tip pushes the plug through the connection channel into the lower chamber.

11. The container according to claim 9, wherein the plug comprises a stem protruding at least partially through the upper chamber towards the tip of the nozzle.

12. The container according to claim 9, wherein the outlet connection comprises an outer thread for screwing the nozzle with the upper chamber of the container.

13. The container according to claim 12, wherein the outlet connection abuts the intermediate folding ring of the nozzle for pushing the tip from the folded state into the unfolded state, when the nozzle is screwed onto the upper chamber of the container.

14. The container according to claim 9, wherein a first component and a second component are provided, wherein a mixture of the first component and the second component produces a gaseous component increasing an inside gas pressure inside the container.

15. The container according to claim 9, wherein at least the lower chamber is made from a flexible material.

16. The nozzle according to claim 1, wherein, if the tip is in the folded state, said volume is enclosed between the connecting part, the intermediate folding ring and the cover plate.

* * * * *